US006019133A

United States Patent [19]

Riedel et al.

[11] Patent Number: 6,019,133

[45] Date of Patent: Feb. 1, 2000

[54] CROSS LEVER VALVE CONTROL MEANS

[75] Inventors: Norbert Riedel, Rheinberg; Ludger Riedel, Xanten, both of Germany

[73] Assignee: Riedel & Söhne oHG, Kam-Lintfort, Germany

[21] Appl. No.: 08/893,716

[22] Filed: Jul. 11, 1997

[30] Foreign Application Priority Data

Jul. 12, 1996 [DE] Germany ..... 196 28 196
Sep. 11, 1996 [DE] Germany ..... 196 36 859

[51] Int. Cl.[7] ..... E03B 1/00

[52] U.S. Cl. ..... 137/636; 137/636.3; 414/685

[58] Field of Search ..... 137/636, 636.1, 137/636.3, 636.4; 74/469, 471 R; 414/685, 4, 728

[56] References Cited

U.S. PATENT DOCUMENTS

| | | | |
|---|---|---|---|
| 3,795,152 | 3/1974 | Campbell | 74/471 R |
| 4,067,546 | 1/1978 | Matsuda et al. | 254/187.4 |
| 4,646,778 | 3/1987 | Tsuji et al. | 137/270 |
| 4,978,273 | 12/1990 | Radke et al. . | |
| 5,112,184 | 5/1992 | Tapper et al. . | |
| 5,288,198 | 2/1994 | Mozingo . | |
| 5,360,312 | 11/1994 | Mozingo | 414/685 |
| 5,429,037 | 7/1995 | Weber et al. . | |

FOREIGN PATENT DOCUMENTS

| | | |
|---|---|---|
| 0 059 219 | 9/1982 | European Pat. Off. . |
| 1 190 757 | 4/1965 | Germany . |

*Primary Examiner*—David J. Walczak
*Attorney, Agent, or Firm*—Sixbey, Friedman, Leedom & Ferguson; David S. Safran

[57] ABSTRACT

A cross lever valve control device (1), especially for a lifting device such as a crane, with at least one manually actuated cross lever (2,3) which can be swivelled in first cross direction ($K_1$) and in a second cross direction ($K_2$), and with at least two control valves (5, 6, 9, 10) which each have one movable valve body (11, 12, 15, 16), cross lever (2, 3) being coupled to valve body (11, 16) of first control valve (5, 10) and valve body (12, 15) of second control valve (6, 9) such that first control valve (5, 10) can be actuated by moving cross lever (2, 3) in first cross direction ($K_1$) and second control valve (6, 9) can be actuated by moving cross lever (2, 3) in second cross direction ($K_2$). To make available a maximum number of functions of cross lever valve control device (1) without the need to release cross lever (2, 3), it is provided as claimed in the invention that cross lever (2, 3) is coupled to valve body (13, 14) of third control valve (7, 8) such that third control valve (7, 8) can be actuated by rotary motion of cross lever (2, 3) around its longitudinal axis (L) in one and the other direction.

8 Claims, 2 Drawing Sheets

CROSS LEVER VALVE CONTROL MEANS

BACKGROUND OF THE INVENTION

1. Field of the Invention

The invention relates to a cross lever valve control means, especially for a lifting device such as a crane, with at least one manually actuated cross lever which can be swivelled in a first cross direction and in a second cross direction, and with at least two control valves each of which have one movable valve body, the cross lever being coupled to the valve body of the first control valve and the valve body of the second control valve such that the first control valve can be actuated by moving the first cross lever in the first cross direction and the second control valve can be actuated by moving the second cross lever in the second cross direction.

2. Description of Related Art

To set certain working positions in lifting devices, such as hydraulic cranes, among others, cross lever valve control means are used in practice. These cross lever valve control means each have at least one cross lever to be manually actuated, via which two control valves can be actuated in the prior art. The control valves are located in a row next to one another and are triggered by a certain arrangement of connecting elements, levers and joints via which the cross lever is joined or coupled to the valves, such that simultaneous actuation of the two control valves with only one cross lever is possible.

But, if more than two control valves are necessary for controlling the movement of the crane, additional levers or cross levers or other manual actuation elements are necessary. This is not only expensive, but also awkward in handling, since the operator must reach from one cross lever to the other as necessary. In addition, this necessary reaching can be very disadvantageous in dangerous situations if a valve not occupied by the cross lever must be quickly actuated and the operator loses critical fractions of a second because of reaching.

SUMMARY OF THE INVENTION

The object of this invention is to develop the known cross lever valve control means such that the aforementioned disadvantages are avoided, and in particular, makes expanded cross lever control possible.

This object is essentially achieved in accordance with the invention by coupling the cross lever to the valve body of a third control valve such that the third control valve can be actuated by rotary motion of the cross lever around its longitudinal axis in one and then the other direction. First of all, the invention offers the possibility of triggering three, instead of the previous two, control valves, at this point with only one control lever. In this way, several actions, for example, of a hydraulic crane, can be easily carried out in parallel so that a flowing motion of the hydraulic crane results without the need for the pertinent cross lever to be released.

Furthermore, the invention is advantageously not only cost favorable, since the number of cross levers necessary can be reduced in a corresponding control direction, but there is also a considerable simplification of handling when the cross lever valve control means is actuated. Finally, there is also the safety advantage of the invention since it is possible to react to any dangerous situations quickly and without any reaching from one cross lever to another.

Other features, advantages and possible applications of this invention follow from the following description of embodiments using the drawings and from the drawing itself.

DETAILED DESCRIPTION OF THE PREFERRED EMBODIMENT

Figure 1:
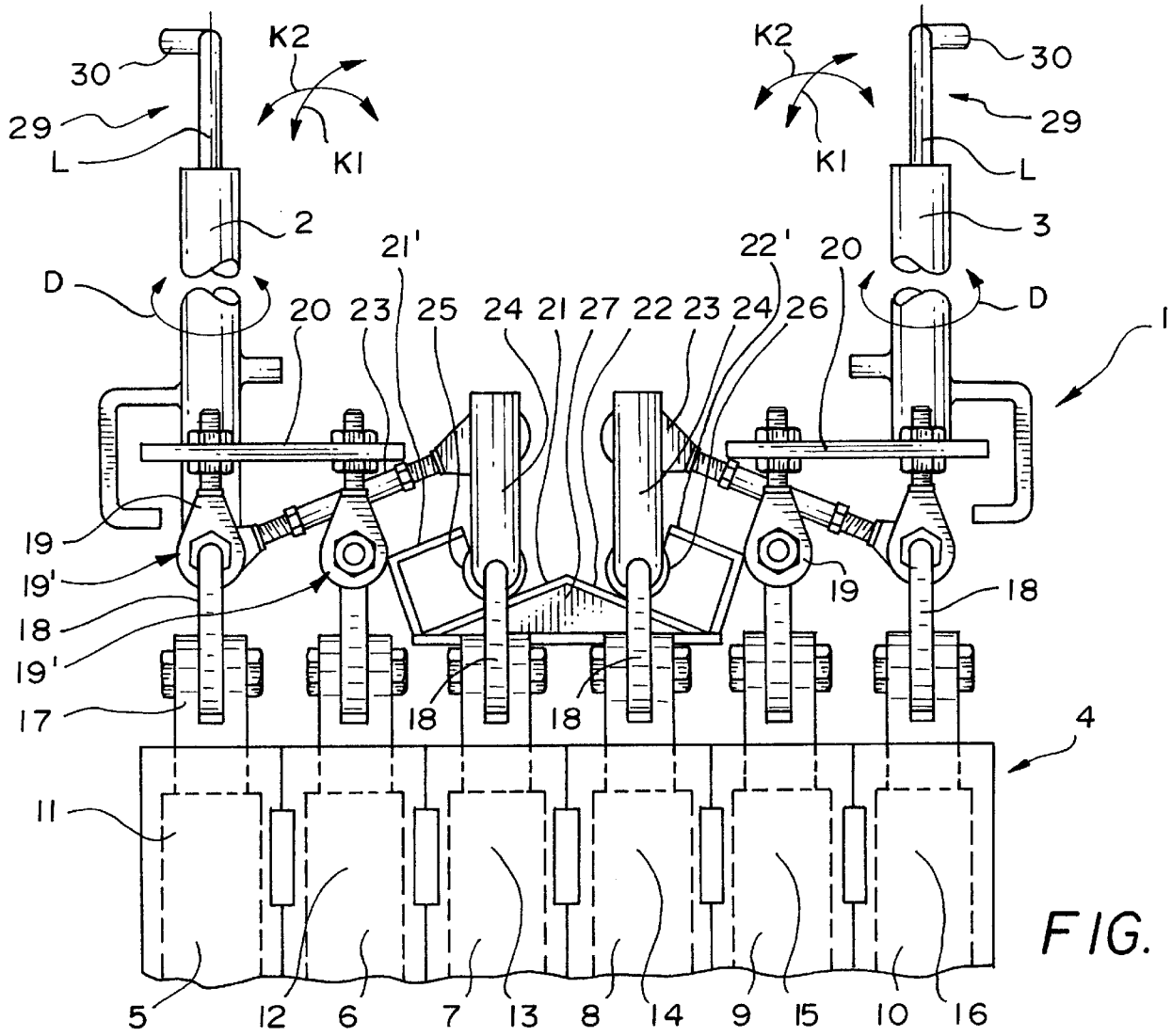
FIG. 1 shows a front view of a cross lever valve control means in accordance with the invention.

In both figures, a cross lever valve control means 1 is shown for a lifting device which is not shown. The lifting device can be a hydraulic crane or the like. Cross lever valve control means 1 has two cross levers 2, 3 to be manually actuated. In addition, cross lever valve control means 1 has a control valve block 4 in which there are six control valves 5, 6, 7, 8, 9, 10 arranged vertically next to one another. Each of the control valves 5, 6, 7, 8, 9, 10 has a movable valve body 11, 12, 13, 14, 15, 16 which is shown merely by broken lines.

Figure 2:
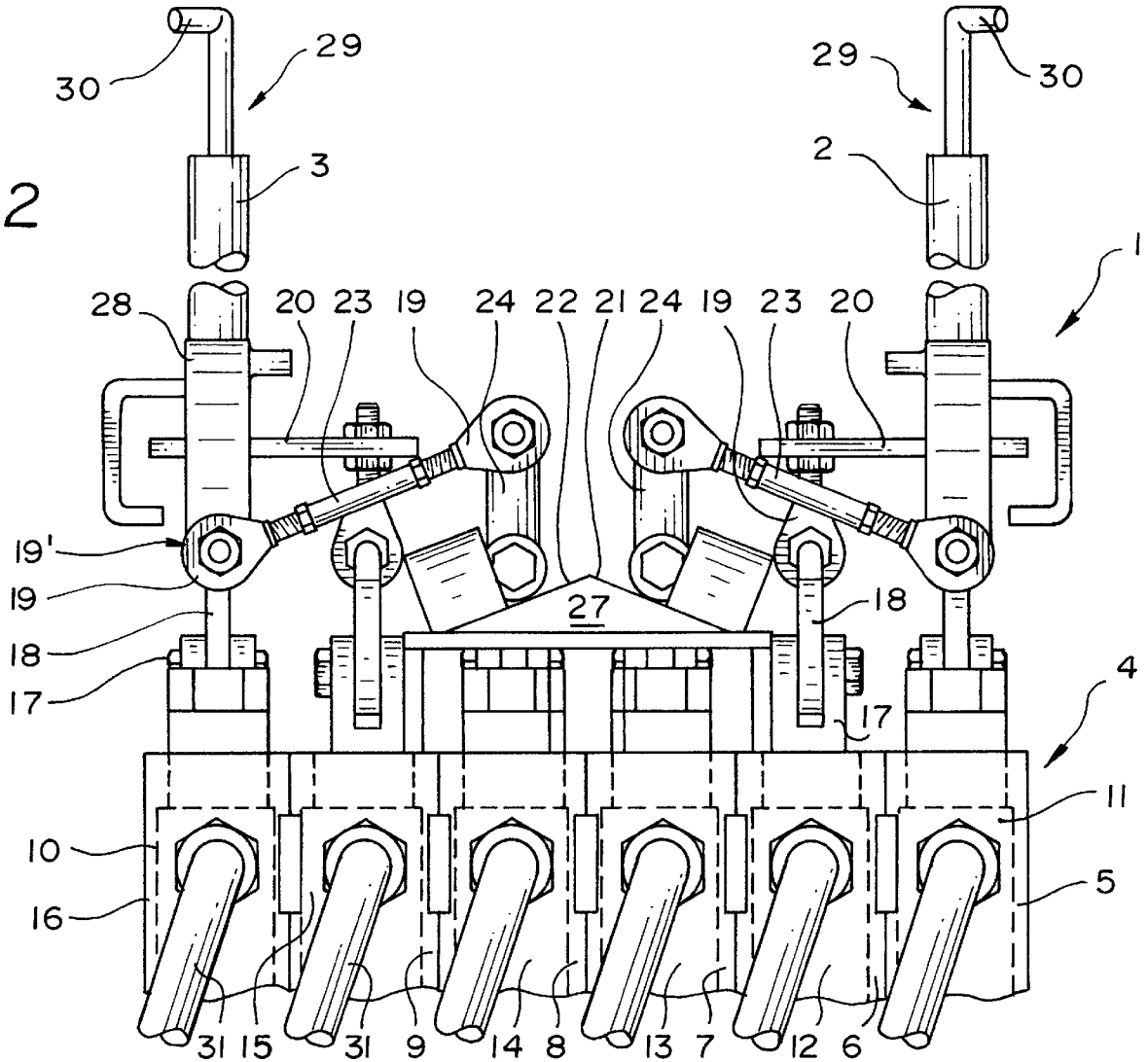
FIG. 2 shows a rear view of the cross lever valve control means from FIG. 1.

Control valves 5 through 10 are hydraulic valves with two flow directions. These control valves can be actuated by releasing a flow in first direction by moving the respective valve body 11 through 16 in one direction, while when the respective valve body 11 through 16 is moved in the other direction, a flow in a second direction is released. FIG. 2 shows that each of the control valves 5 through 10 has a hydraulic connection 31 via which hydraulic fluid is supplied and the control valves 5 through 10 are pressurized. The function of these control valves is known to one skilled in the art and does not require further explanation here.

In the embodiment shown, first of all, two control valves 5, 10 can be actuated by moving respective cross lever 2, 3 in the first cross direction $K_1$, by a forward and backward motion. First cross direction $K_1$ runs at a right angle to second cross direction $K_2$. By swinging respective cross lever 2, 3 in the second cross direction $K_2$, the respective second control valves 6, 9 can be actuated.

To actuate first control valves 5, 10 via the cross levers 2, 3, the respective valve body 11, 16 is mechanically joined to the respective cross lever 2, 3. In particular, each valve body 11, 16 is provided with a fork head 17 on its upper end.

Also, all of the other valve bodies 12, 13, 14, 15 have a fork head 17 of is type. A valve actuation rod 18 is connected in each fork head 17, and valve bodies 12, 15 are mechanically joined via a connecting part 19 to a plate-like connecting element 20. So that manual forces in the respective direction can cause deflection of the associated valve body, a stationary abutment in the form of a ball joint 19' is located between the valve actuating rod 18 and the connecting part 19. Connecting element 20 is aligned roughly transversely relative to valve actuating rod 18, and is, in turn, securely joined to a respective cross lever 2, 3.

If, for example, the cross lever 2 is now swung in first cross direction $K_1$, and with reference to FIG. 1, out of the plane of the figure towards the observer, the first valve body 11 of the first control valve 5 is moved downward. By swinging the cross lever 2 in the opposite direction, the valve body 11 is raised. If the cross lever 2 is now swung in the second cross direction $K_2$ and to the right, the second valve body 12 of the second control valve 6 is moved downward, while when cross lever 2 is swivelled in second cross direction $K_2$ to the left valve body 12 is moved upward.

It is now significant that each of the cross levers 2, 3 is also coupled to a third valve body 13, 14 of the respective third control valve 7, 8, such that respective third control valve 7, 8 can be actuated by a rotary motion of the corresponding cross lever 2, 3 around its longitudinal axis L, in one and the other direction (direction of rotation D), therefore clockwise and counterclockwise.

In the embodiment shown, the rotary motion of cross lever 2 in one and the other direction is converted into translational motion of pertinent valve body 13, 14 via inclined plane 21, 22, respectively, as restricted guidance. For this reason, on respective cross lever 2, 3, a rod 23 is supported which is joined to the valve actuating rod 18 of the respective third and fourth valve body 13, 14 via a connecting part 19. To do this, an extension 24 is welded to respective valve actuating rods 18 in the embodiment shown. Extensions 24 are simply parts of valve actuating rods 18 themselves. A roller 25, 26 runs on each inclined plane 21, 22 and is supported on the respective valve actuating rod 18. Support of rollers 25, 26 via ball bearings is recommended to achieve ease of running.

In the embodiment shown, there are two inclined planes 21, 22 on a common component 27 which, in turn, is attached to valve control block 4. Part 27 can be a angled and/or welded piece of sheet metal. Above the two inclined planes 21, 22 is an abutment 21', 22' which corresponds to inclined planes 21, 22 and which is used for restrained guidance of the pertinent roller when the pertinent valve moves downward. The restrained guidance could also be executed differently, for example, by two bearings or rollers located on top of one another, of which one is above and the other below the respective inclined plane 21, 22.

The connection of rod 23 to respective cross lever 2, 3 can be seen most clearly in FIG. 2. Arm 28 which projects from cross lever 2, 3, preferably radially and by a few centimeters, is attached, preferably welded, to cross lever 2, 3. Here, arm 28 is angled downward adjacent to its radially projecting part, which cannot be seen in the figure. One end of rod 23 is joined to the angled part of arm 28 via connecting part 19. Rod 23 is matched obliquely to the pitch of respective inclined plane 21, 22. The connection between rod 23 and arm 28, on the one hand, and the corresponding extension 24, on the other, is such that relative motion of rod 23 against arm 28, on the one hand, and extension 24, on the other, is possible when respective cross lever 2, 3 is turned. In this embodiment, there is ball joint 19' between connection part 19 and arm 28.

So that the cross lever 2, 3 can be moved at all in direction of rotation D, cross lever 2, 3 can turn relative to connecting element 20 or is pivotally mounted in connecting element 20. In addition to direct rotary support in the connecting element, it is also possible, for example, that, on connecting element 20, there is a solid journal on which cross lever 2, 3 is seated to turn, it being locked on the journal such that cross lever 2, 3 cannot be withdrawn upward, therefore in the direction of longitudinal axis L.

Actuation of third control valve 7 via cross lever 2 takes place such that, when cross lever 2 is turned counterclockwise, valve body 13 is moved down, while when cross lever 2 is turned clockwise, roller 25 runs onto inclined plane 21, by which third valve body 13 is moved upward. In doing so, it goes without saying that, between the lower end of the valve actuating rod 18 and the fork head 17 of valve body 13, there is sufficient play to enable corresponding motion of roller 25 on inclined plane 21. It is also otherwise possible for a joint to be provided between the extension 24 and valve actuating rod 18 of third valve body 13.

So that the force expended to turn cross lever 2, 3 is as small as possible, operator end 29 of each cross lever 2, 3 is angled relative to longitudinal axis L and is provided with a corresponding bend 30. Bend 30 is ultimately nothing more than an elongated grip element especially for mounting of an eccentric gripping knob.

It should be pointed out that, instead of the selected use of rollers 25, 26 which are moved along inclined planes 21, 22, of course other means can be used. Thus, for example, on each cross levers 2, 3, there could be an inclined plane which corresponds to inclined planes 21, 22 and which runs along the respective inclined plane 21, 22 in direction D when the respective cross lever 2, 3 is turned. Alternatively, deflection of the third valve body could also take place via a sheathed cable or sheathed cable system or also by raising the corresponding cross lever.

In another embodiment, it is possible to eliminate the use of an inclined plane. But, to do this, the third control valves 7, 8 would have to be in another arrangement relative to cross levers 2, 3, specifically at a right angle to longitudinal axis L of cross levers 2, 3. In an arrangement of the third control valves at a right angle to longitudinal axis L, the rotary motion of the cross levers would have to be converted simply into a translational reciprocating motion, and this done directly.

We claim:

1. A cross lever valve control device comprising at least first, second, and third control valves each of which has a movable valve body, and at least a first manually actuated cross lever which is mounted to swing in a first cross direction and in a second cross direction relative to the control valves and to rotate about a longitudinal axis of said first manually actuated cross lever; wherein said first manually actuated cross lever is coupled to the movable valve body of the first control valve and the valve body of the second control valve in a manner enabling the first control valve to be actuated by moving said first manually actuated cross lever in said first cross direction and enabling the second control valve to be actuated by moving said first manually actuated cross lever in said second cross direction; and wherein the first manually actuated cross lever is coupled to the valve body of the third control valve in a manner enabling the third control valve to be actuated by rotary motion of the first manually actuated cross lever around said longitudinal axis; wherein linkage means are provided for converting the rotary motion of the first manually actuated cross lever is into a translational motion of the valve body of the third control valve; and wherein said linkage means for converting the rotary motion of the first manually actuated cross lever into a translational motion of valve body of the third control valve comprises a valve actuating rod and an inclined guide plane on which a part of the valve actuating rod runs.

2. Cross lever valve control device as claimed in claim 1, wherein the valve body of the third control valve is located and is movable roughly parallel relative to said longitudinal axis of the cross lever; wherein a rod is supported on the first manually actuated cross lever and is joined to the valve body of the third valve via a valve actuating rod which is located essentially parallel relative to said longitudinal axis; and wherein the part of the valve actuating rod that runs on said inclined plane is a roller joined to the valve actuating rod.

3. Cross lever valve control device comprising at least first, second, and third control valves each of which has a movable valve body, and at least a first manually actuated cross lever which is mounted to swing in a first cross direction and in a second cross direction relative to the control valves and to rotate about a longitudinal axis of said first manually actuated cross lever; wherein said first manually actuated cross lever is coupled to the movable valve body of the first control valve and the valve body of the second control valve in a manner enabling the first control valve to be actuated by moving said first manually actuated cross lever in said first cross direction and enabling the second control valve to be actuated by moving said first manually actuated cross lever in said second cross direction; and wherein the first manually actuated cross lever is coupled to the valve body of the third control valve in a manner enabling the third control valve to be actuated by rotary motion of the first manually actuated cross lever around said longitudinal axis; wherein a plate-shaped connecting element is joined to the manually actuated cross lever for actuating the first control valve and the second control valve and further comprising a second manually actuated cross lever via which three additional first, second and third control valves can be actuated at one time; wherein all of the control valves are located next to one another in a control valve block; wherein two of the control valves which are positioned outermost in the control valve block are first control valves, each of which is actuated by motion of the respective cross lever; wherein said second control valves are each positioned inwardly adjacent to a respective first control valve and is actuated by motion of the respective cross lever; and wherein two of the control valves which are most centrally positioned within the valve block are the third control valves, each of which is actuated by the respective cross lever.

4. Cross lever valve control device as claimed in claim 3, further comprising inclined planes, each of which forms a means for converting rotary motion of the respective one of the manually actuated cross levers to a translational motion of a respective one of the third control valves.

5. Cross lever valve control device as claimed in claim 1, wherein a projecting grip element is provided on an operator end of the manually actuated cross lever.

6. Cross lever valve control device as in claim 1, wherein a plate-shaped connecting element is joined to the manually actuated cross lever for actuating the first control valve and the second control valve.

7. Cross lever valve control device as claimed in claim 6, wherein the manually actuated cross lever is rotatable relative to said connecting element.

8. Cross lever valve control device comprising at least first, second, and third control valves each of which has a movable valve body, and at least a first manually actuated cross lever which is mounted to swing in a first cross direction and in a second cross direction relative to the control valves and to rotate about a longitudinal axis of said first manually actuated cross lever; wherein said first manually actuated cross lever is coupled to the movable valve body of the first control valve and the valve body of the second control valve in a manner enabling the first control valve to be actuated by moving said first manually actuated cross lever in said first cross direction and enabling the second control valve to be actuated by moving said first manually actuated cross lever in said second cross direction; wherein the first manually actuated cross lever is coupled to the valve body of the third control valve in a manner enabling the third control valve to be actuated by rotary motion of the first manually actuated cross lever around said longitudinal axis; wherein a plate-shaped connecting element is joined to the manually actuated cross lever for actuating the first control valve and the second control valve; wherein the manually actuated cross lever is rotatable relative to said connecting element; and wherein the manually actuated cross lever is pivotally mounted to the connecting element.

* * * * *